US007972171B2

(12) United States Patent
Teh

(10) Patent No.: US 7,972,171 B2
(45) Date of Patent: Jul. 5, 2011

(54) CARD EDGE CONNECTOR

(75) Inventor: Chien Ching Teh, Singapore (SG)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/938,615

(22) Filed: Nov. 3, 2010

(65) Prior Publication Data

US 2011/0104952 A1 May 5, 2011

(30) Foreign Application Priority Data

Nov. 3, 2009 (SG) ..... 200907315-6

(51) Int. Cl.
*H01R 13/73* (2006.01)

(52) U.S. Cl. ..... 439/567; 439/329; 439/570; 439/571

(58) Field of Classification Search ..... 439/567–571, 439/329

See application file for complete search history.

(56) References Cited

U.S. PATENT DOCUMENTS 5,975,947 A * 11/1999 Wu et al. ..... 439/567
6,168,464 B1 * 1/2001 Choy et al. ..... 439/567
6,558,200 B1 * 5/2003 Choy ..... 439/637
6,638,106 B1 * 10/2003 Wu ..... 439/567

* cited by examiner

*Primary Examiner* — Briggitte R Hammond
(74) *Attorney, Agent, or Firm* — Stephen L. Sheldon

(57) ABSTRACT

A card edge connector comprises a pair of mount members attached to the bottom of the insulating housing thereof. Each mount member comprises a body portion, at least one fitting nail connected to the body portion and configured to be disposed transversely for being soldered on a printed circuit board, and a tab portion connecting to the body portion and configured to be freely insertable into an aperture formed on the printed circuit board.

11 Claims, 12 Drawing Sheets

CARD EDGE CONNECTOR

RELATED APPLICATIONS

This application claims priority to Singapore Application No. 200907315-6, filed Nov. 3, 2009, which is incorporated herein by reference in its entirety.

FIELD OF THE INVENTION

The present invention relates to a card edge connector, and more particularly, to a card edge connector for mounting on a printed circuit board.

DESCRIPTION OF THE RELATED ART

Electrical connectors are commonly provided on printed circuit boards for connecting external electronic devices with their contact terminals electrically coupled to electrical circuit traces on the printed circuit board. The contact terminals may include solder tails projecting from the electrical connector and inserted into plated through-holes in the printed circuit board, or the contact terminals may include solder tails generally parallel to the printed circuit board for surface mounting to electrically engage circuit traces on the printed circuit board. In either instance, the contact terminals are connected to the circuit traces on the printed circuit board most commonly by soldering.

Generally, electrical connectors are fixed to printed circuit boards using multiple board locks. Usually, the board locks are respectively inserted into through holes in the printed circuit board, each having multiple barbs for interference fit with the inner wall defining the through hole. The electrical connectors are tightly and firmly assembled on the printed circuit board at room temperature. However, during the soldering of terminals to the printed circuit board, the electrical connector and the printed circuit board may expand differently, and due to the firm fixation of the electrical connector, the printed circuit board may deflect, likely resulting in inferior connections.

In addition, some electrical connectors are fixed to a printed circuit board using mounting pads. Usually, solder pads adapted for the mounting pads are of small size in order to save space on the printed circuit board for the compact circuit arrangement. However, reduced areas of solder pads cause weaker mechanical strength of solder joints, resulting in insufficient holding strength for the electrical connectors. Consequently, certain individuals would appreciate an improved electrical connector.

SUMMARY OF THE INVENTION

IA card edge connector is configured to mount on a printed circuit board having a plurality of apertures. The card edge connector includes an insulating housing, a plurality of terminals and a pair of first mount members. The insulating housing comprises a pair of opposite end portions, a card receiving slot extending between the two end portions, and a pair of first slits respectively formed on the bottom of the two end portions. The plurality of terminals are arrayed along the card receiving slot. Each first mount member comprises a body portion configured to be received within the respective first slit, a tab portion connected to the body portion and configured to be freely insertable into the respective aperture, and at least one fitting nail connected to the body portion and configured to be disposed transversely for being soldered on the printed circuit board.

BRIEF DESCRIPTION OF THE DRAWINGS

The invention will be described according to the appended drawings in which.

DETAILED DESCRIPTION OF THE INVENTION

Hereinafter, embodiments of the present invention are described in detail with reference to the attached drawings. One benefit of the depicted embodiment is that a card edge connector includes a pair of mount members. The mount members can provide several benefits, including a positioning function, enhancing soldering joint strength, restricting the movement of the card edge connector, and allowing the shrinkage or expansion of the card edge connector during soldering.

Figure 3:
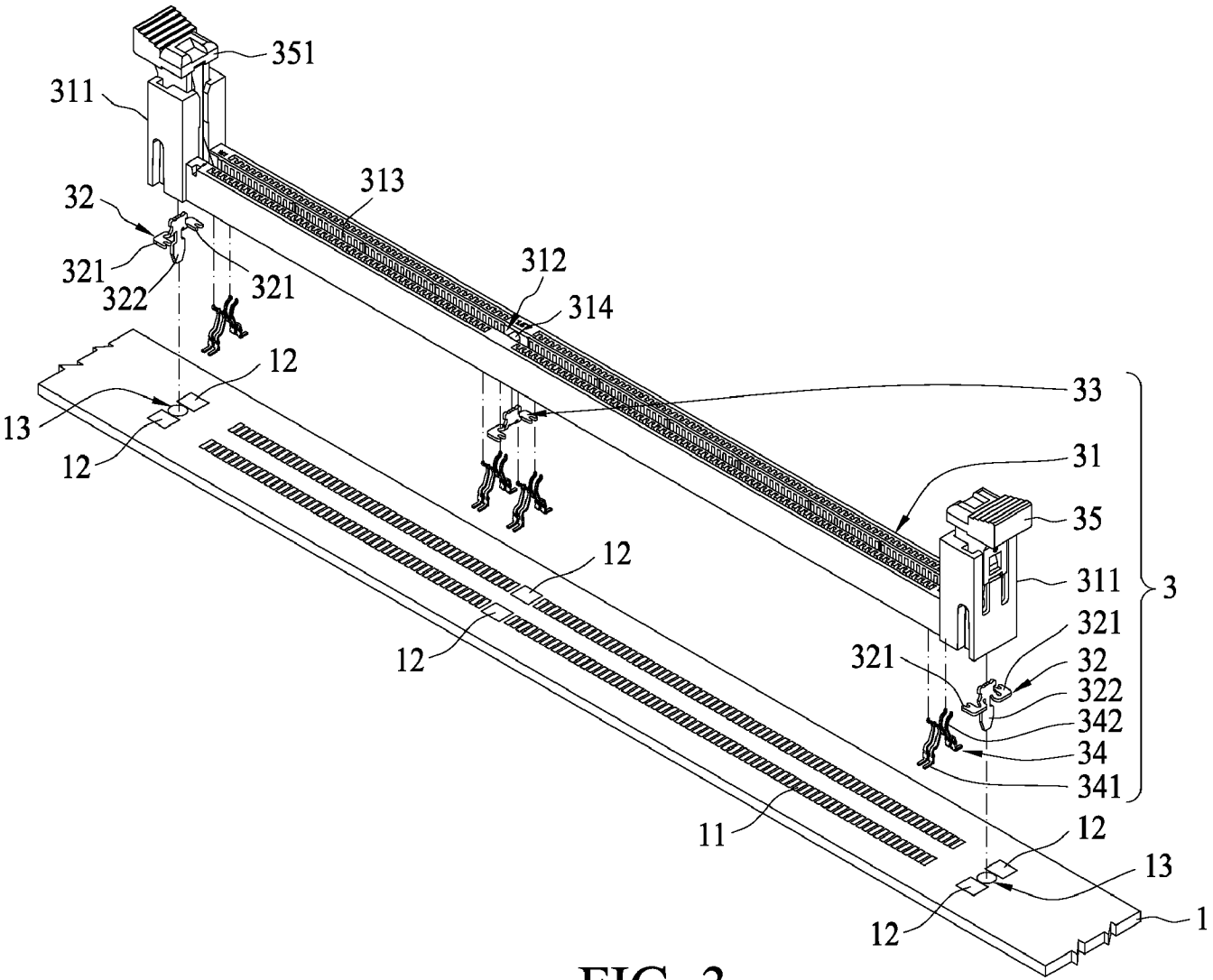
FIG. 3 is an exploded view of the card edge connector of FIG. 2.
Figure 4A:
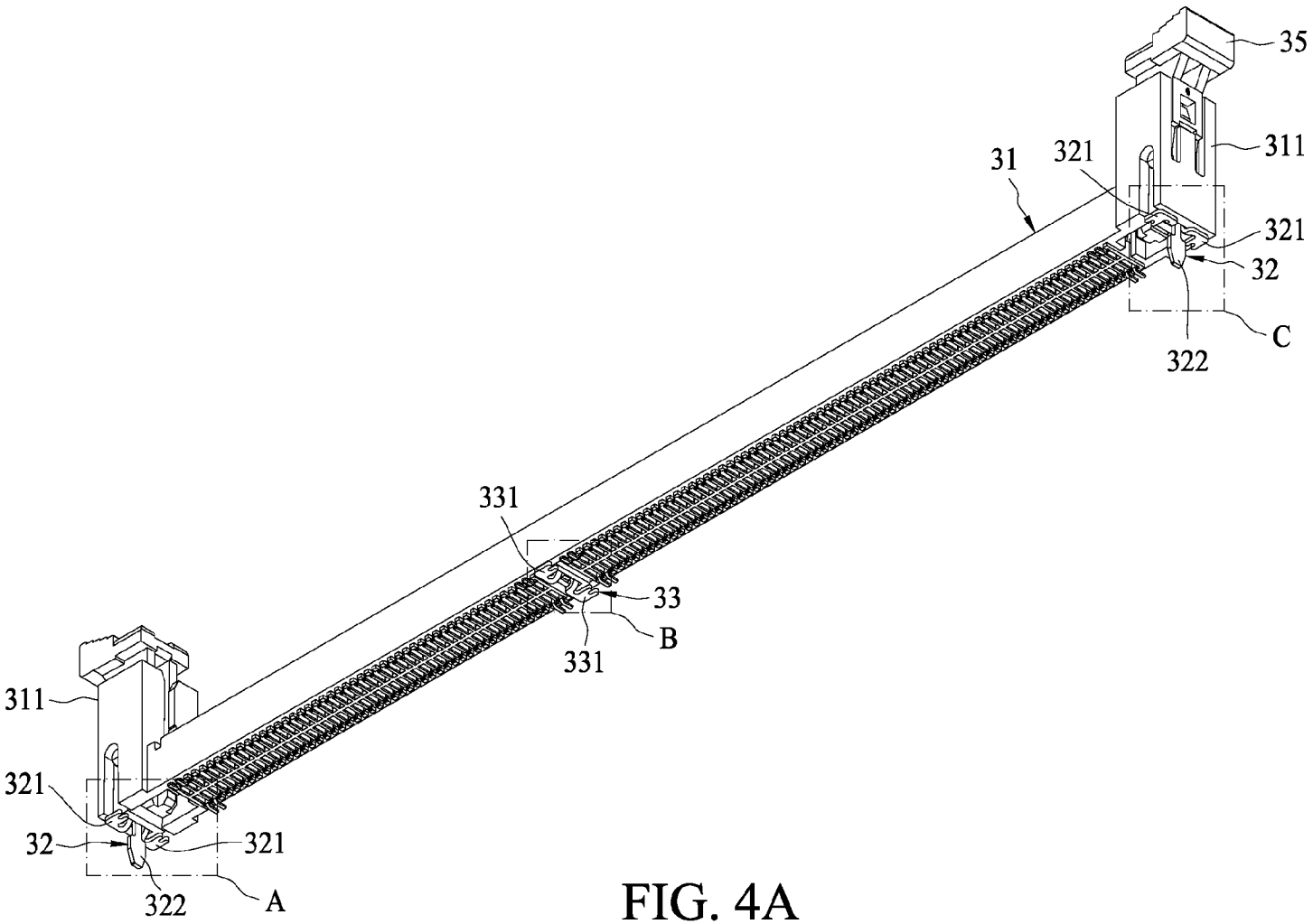
FIG. 4A is a perspective bottom view showing a card edge connector according to one embodiment of the present invention.
Figure 4B:
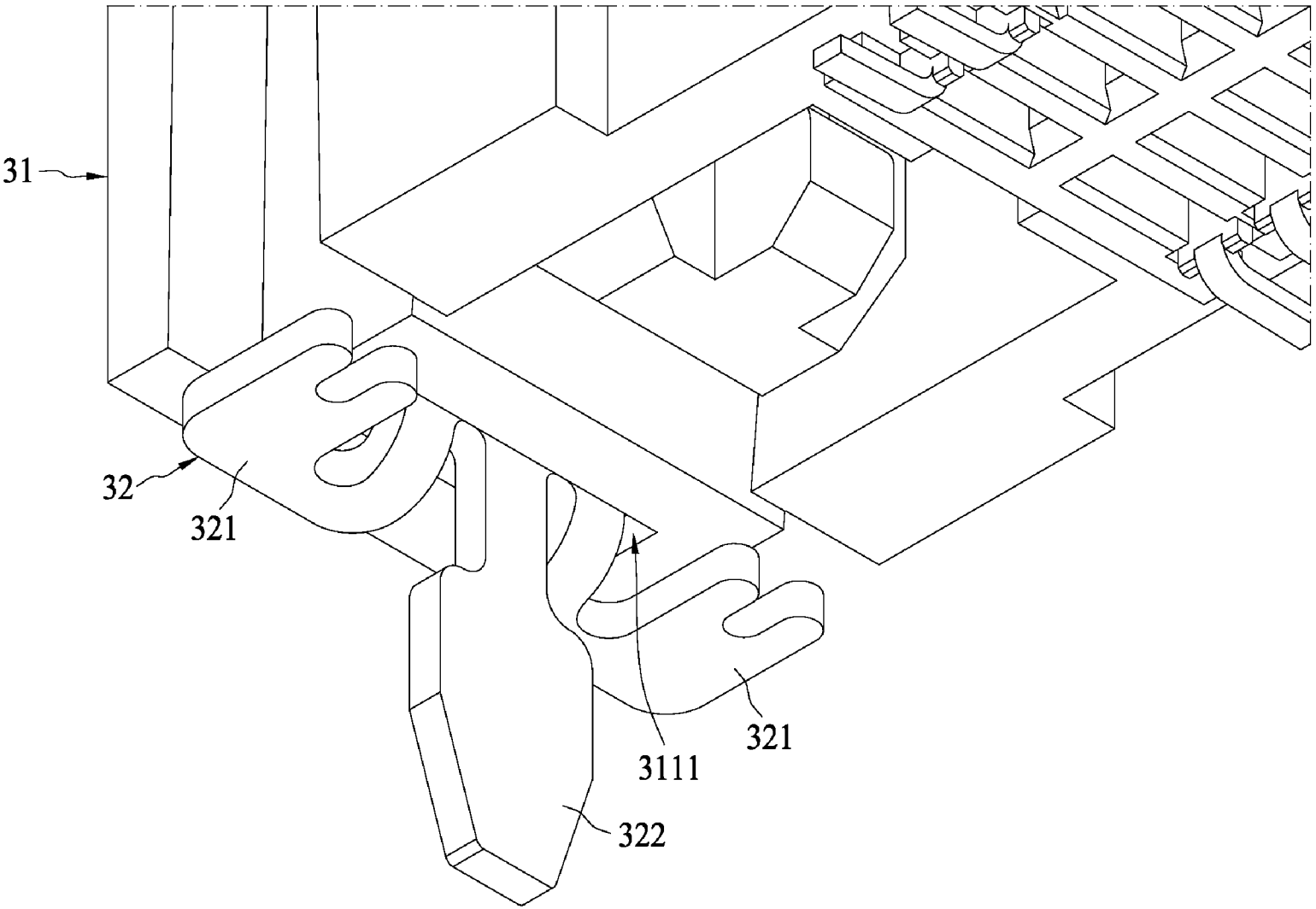
FIG. 4B is an enlarged view of a rectangular A in FIG. 4A.
Figure 4C:
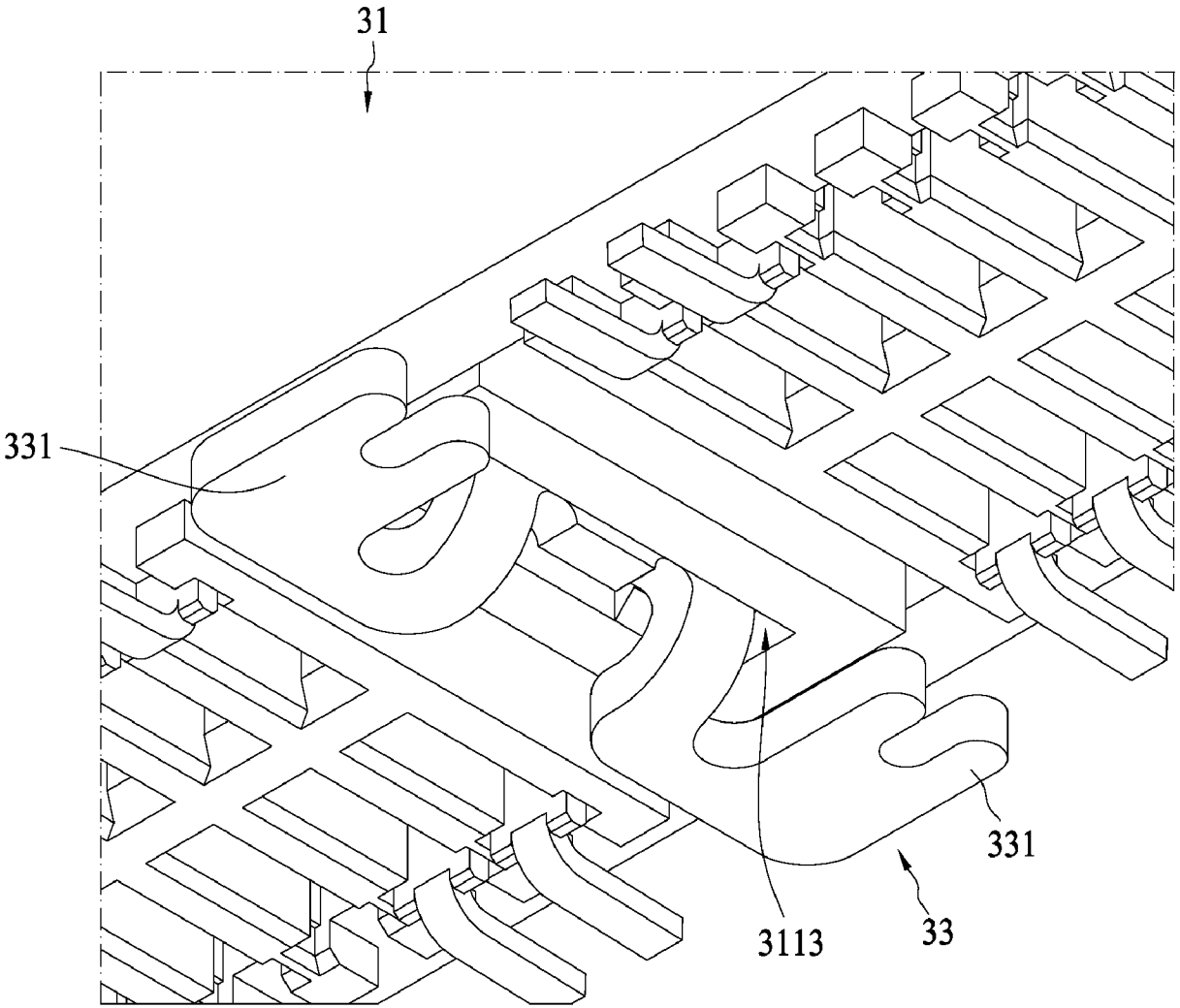
FIG. 4C is an enlarged view of a rectangular B in FIG. 4A.
Figure 4D:
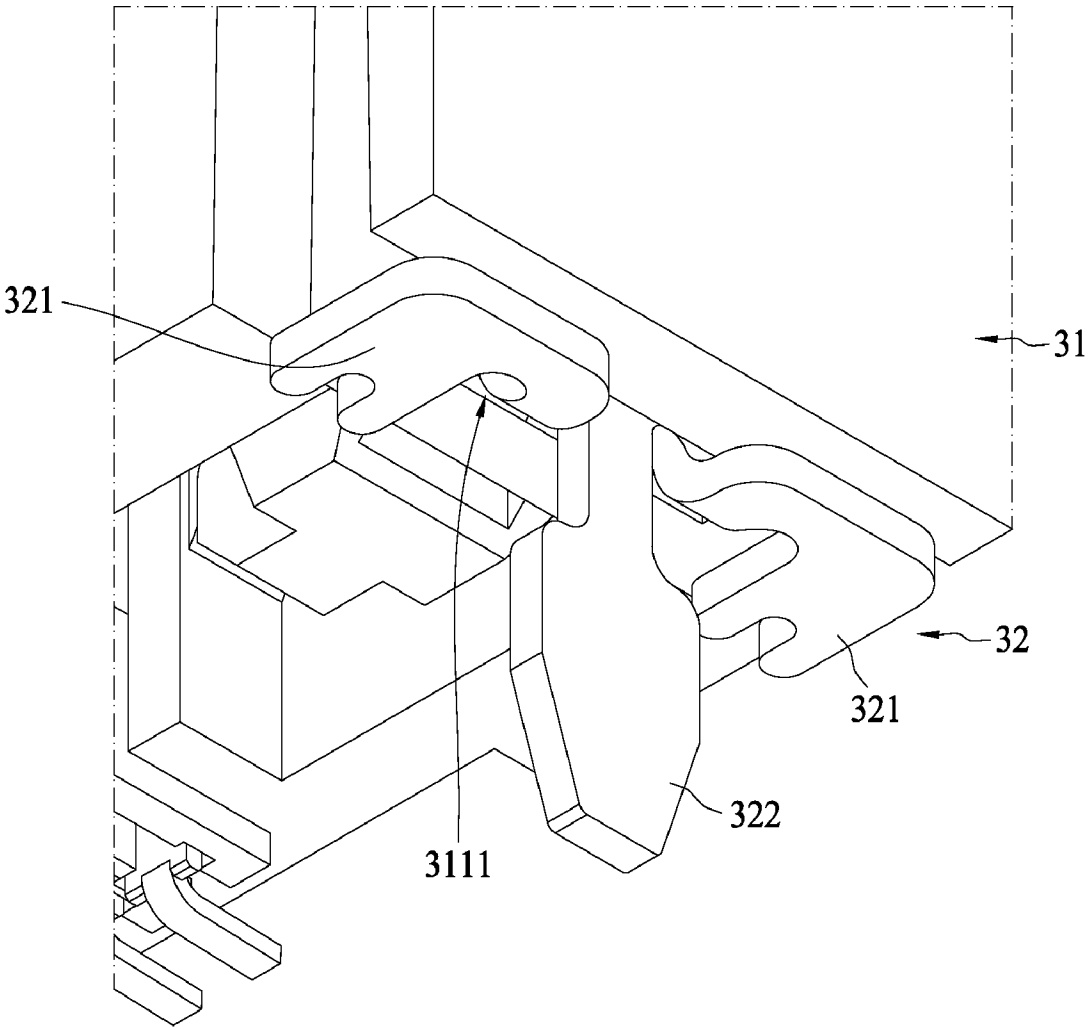
FIG. 4D is an enlarged view of a rectangular C in FIG. 4A.

As illustrated in FIG. 3, a pair of first mount members 32 and a second mount member 33 of one embodiment of the present invention are illustratively embodied in a card edge connector 3 including a plurality of arrayed terminals 34 having tail portions 341 extending beyond and parallel to the bottom of an insulating housing 31 and configured to be soldered onto the respective contact pads 11 of the printed circuit board 1.

Figure 1:
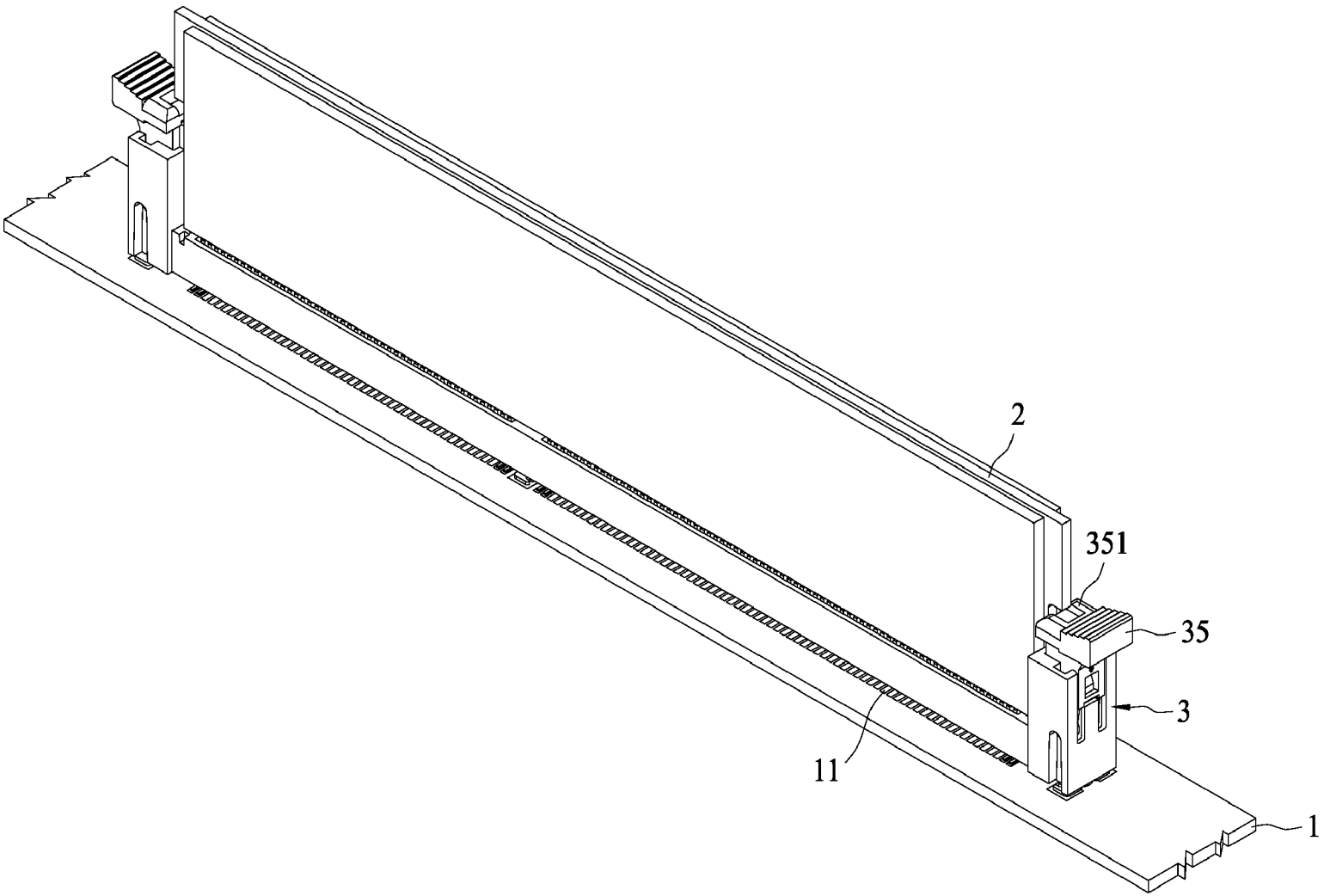
FIG. 1 is a perspective view illustrating an electrical card inserted into a card edge connector mounted on a printed circuit board according to one embodiment of the present invention.
Figure 2:
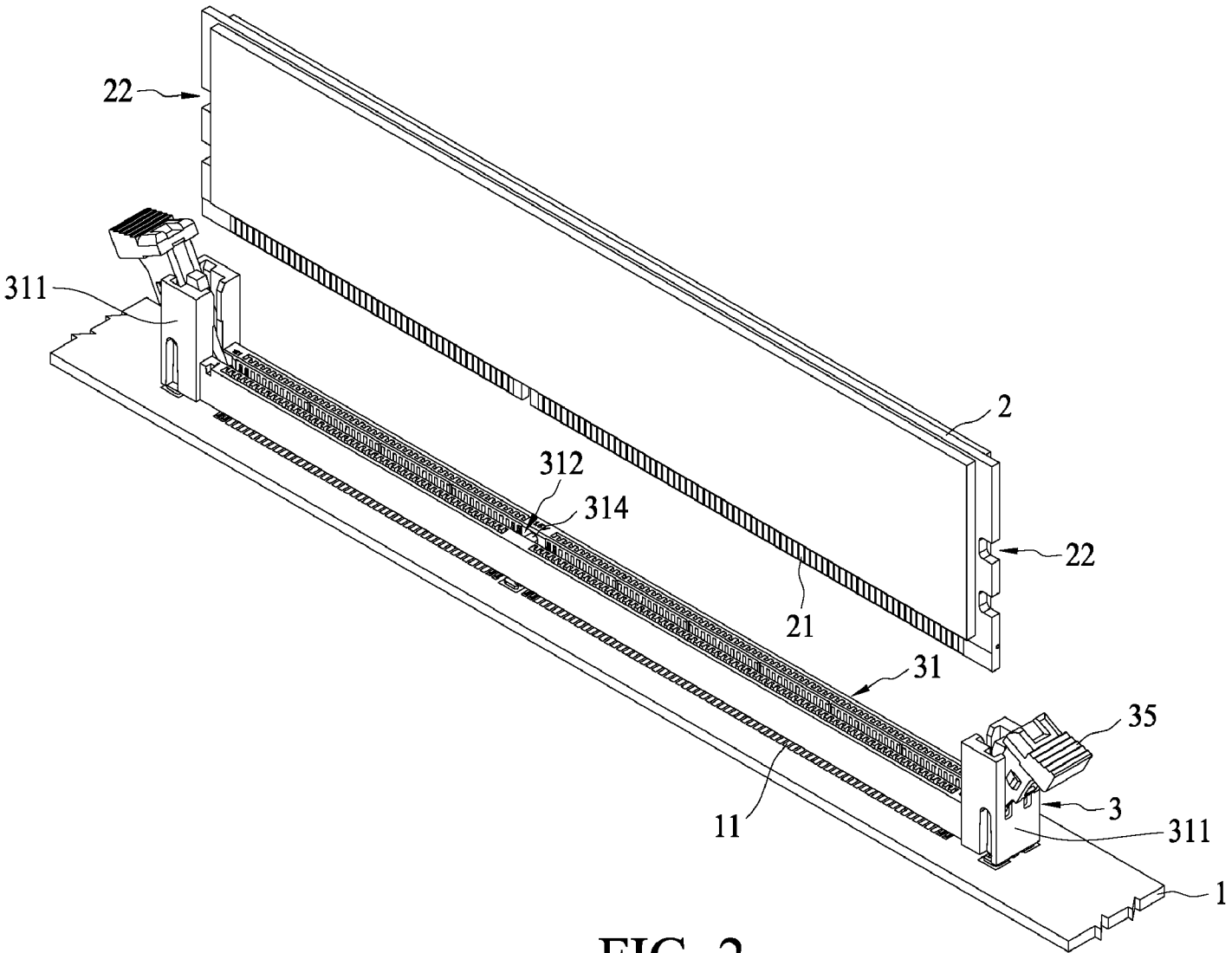
FIG. 2 is a perspective view illustrating a card edge connector mounted on a printed circuit board and a separate electrical card according to one embodiment of the present invention.

Referring to FIG. 1 to FIG. 3, the elongated card edge connector 3 includes an insulating housing 31 having two opposite end portions 311 respectively receiving two card latch-ejector members 35 and an upward-facing card receiving slot 312 extending between the two end portions 311 for receiving a vertically disposed electrical card 2 as shown in FIGS. 1 and 2. The insulating housing 31 comprises a plurality of cavities 313 partially surrounding the card receiving slot 312, for respectively receiving the plurality of terminals 34. Each terminal 34 includes a contact portion 342 configured to protrude into the card receiving slot 312 for engagement of a respective contact pad 21 disposed on the electrical card 2. A plurality of contact pads 11 are arrayed on the printed circuit board 1 in a manner such that the tail portions 341 of the terminals 34 can be respectively soldered thereon. Each card latch-ejector member 35, configured to pivotally move within the respective end portion 311 of the insulating housing 31, includes a latch portion 351 for engaging the respective notch 22 for locking the electrical card 2 and an ejector portion (not shown) for ejecting the electrical card 2. The insulating housing 31 can comprise a polarized rib 314 for preventing the electrical card 2 from being incorrectly installed.

As shown in FIG. 3 and FIG. 4A to FIG. 4D, the two first mount members 32 and the second mount member 33 are disposed on the bottom of the insulating housing 31. Specifically, the two first mount members 32 are separately disposed on the bottoms of the end portions 311, and the second mount member 33 can be disposed below the polarized rib 314. Each first mount member 32 can comprise a pair of fitting nails 321 spaced apart transverse to the elongation direction of the insulating housing 31 and a tab portion 322 disposed between the fitting nails 321. Similarly, the second mount member 33 can comprise a pair of fitting nails 331 spaced apart transverse to the elongation direction of the insulating housing 31; however, the second mount member 33 may not include a tab portion analogous to the tab portion 322 of the first mount member 32.

Referring to FIG. 3, a plurality of solder pads 12 are disposed on the printed circuit board 1, provided for soldering the fitting nails 321 and 331 of the first and second mount members (32 and 33) thereon for fixation by soldering. The printed circuit board 1 includes apertures 13 disposed on the opposite sides of the contact pads 11 in the array direction of the contact pads 11. The apertures 13 are configured for positioning the card edge connector 3 during assembly of the card edge connector 3. The downward-extending tab portions 322 of the first mount members 32 are correspondingly inserted into the apertures 13 after the card edge connector 3 is installed. In particular, the apertures 13 can be plated through holes such that the tab portions 322 can be soldered thereto.

Moreover, the tab portions 322 are configured to be freely insertable into the respective apertures 13. Namely, the maximum dimension of the tab portion 322 is smaller than the aperture 13 so that the card edge connector 3 is loosely confined after assembly and is allowed to shrink or expand during soldering. Nevertheless, the tab portions 322 are also configured in a manner such that when the card edge connector 3 is installed, the tail portions 341 of the terminals 34 can be properly aligned with the contact pads 11 on the printed circuit board 1. In other words, the tab portion 322 is configured to move within the aperture 13 while such a movement does not cause the tail portion 341 of the terminal 34 to engage two adjacent contact pads 11 on the printed circuit board 1.

Figure 6:
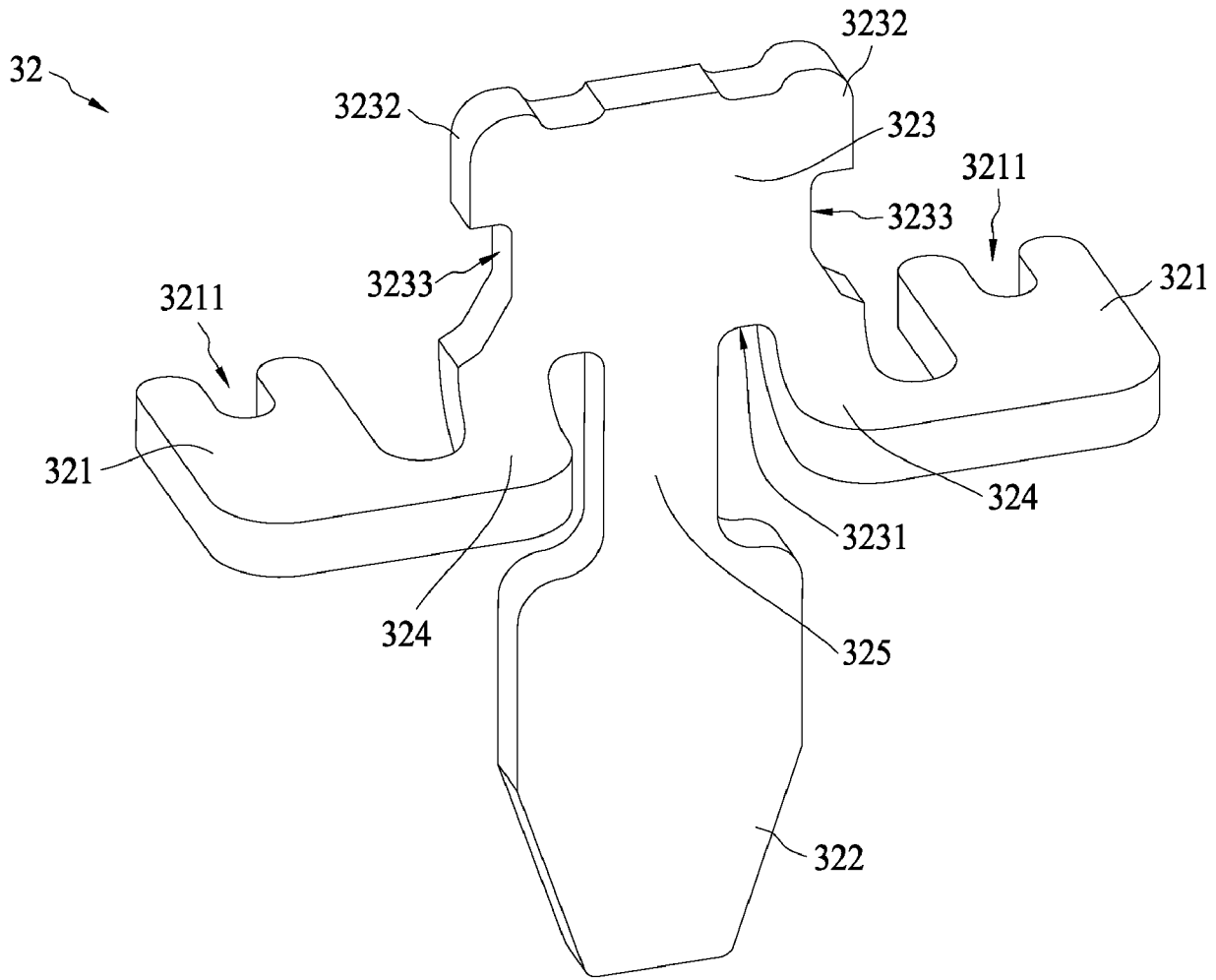
FIG. 6 is a perspective view showing a first mount member according to one embodiment of the present invention.

Referring to FIG. 6, each first mount member 32 may comprise two fitting nails 321, a tab portion 322, and a body portion 323. The body portion 323, transversely disposed to and between the fitting nails 321, is in connection with the fitting nails 321 respectively using two connecting portions 324 extending from a side edge 3231 of the body portion 323. The body portion 323 may comprise a plurality of projections 3232 respectively protruding from two opposite sides 3233 of the body portion 323 as fastening means of the first mount member 32. The tab portion 322, disposed transversely to the fitting nails 321, can also connect to the side edge 3231 of the body portion 323 using a connecting portion 325. The distal end of the tab portion 322 can have a tapered shape for facilitating the installation of the first mount member 32 into the respective aperture 13. In addition, an indentation 3211 can be formed on an edge of each fitting nail 321 to strengthen the connection of each fitting nail 321 to the respective solder pad 12.

Figure 7:
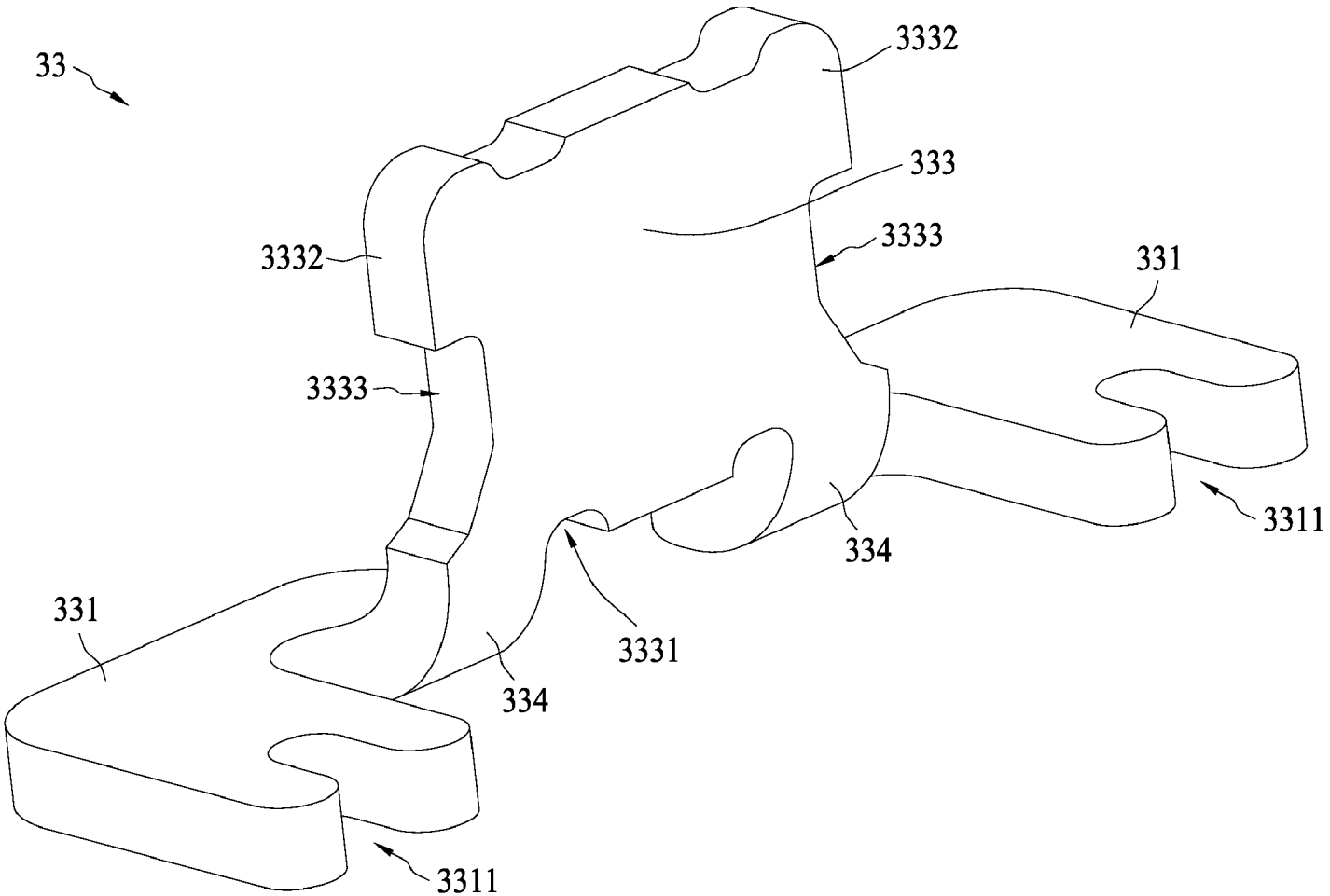
FIG. 7 is a perspective view showing a second mount member according to one embodiment of the present invention.

Similarly, the second mount member 33, as shown in FIG. 7, may comprise a pair of fitting nails 331 spaced apart from each other and a body portion 333 disposed transversely to and between the pair of fitting nails 331. The two fitting nails 331 are connected to the body portion 333 using two connecting portions 334 extending from a side edge 3331 of the body portion 333. Each fitting nail 331 may include an indentation 3311 formed on an edge thereof. The body portion 333 can also include a plurality of projections 3332 protruding from two opposite sides 3333 of the body portion 333. In an embodiment, the second mount member 33 does not include a tab portion similar to the tab portion 322 of the first mount member 32. However, the second mount member 33 may also be designed to have a tab portion performing functions similar to those of the tab portion 322 of the first mount member 32.

Figure 5:
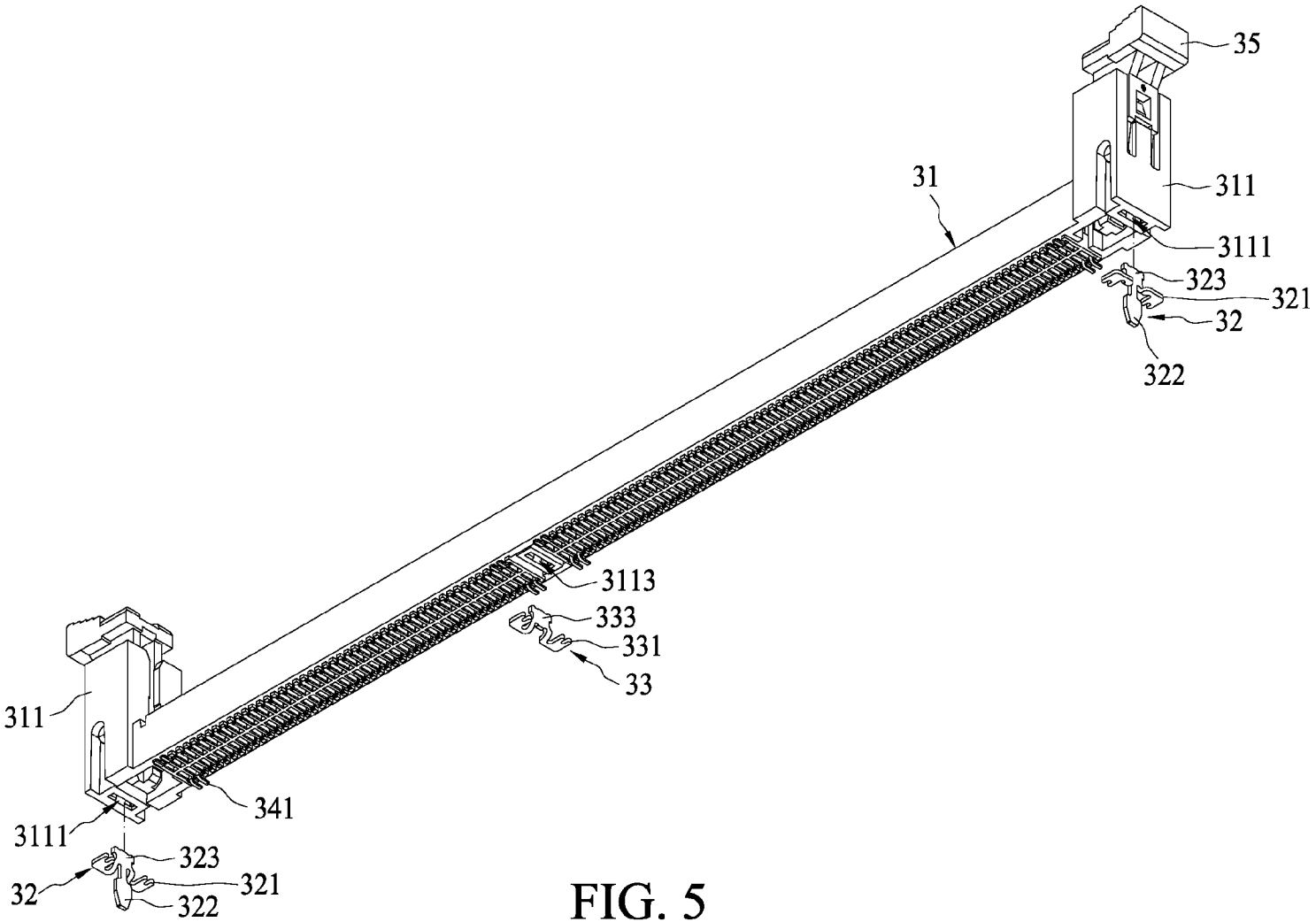
FIG. 5 is a perspective view showing a pair of first mount members, a second mount member, and the bottom of a card edge connector according to one embodiment of the present invention.
Figure 8:
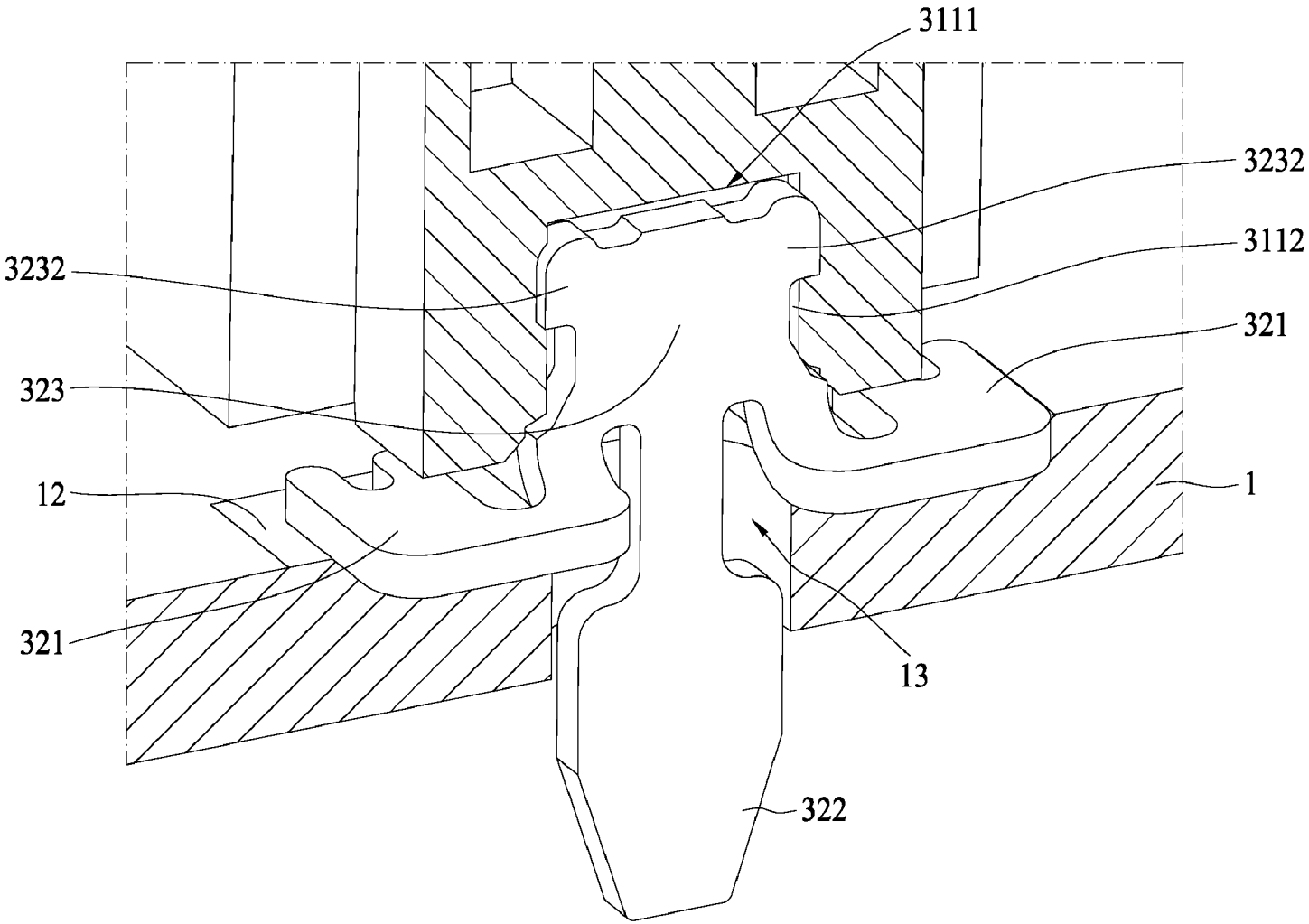
FIG. 8 is an enlarged cross-sectional perspective view showing the engagement between a first mount member and a first slit formed on the insulating housing of a card edge connector according to one embodiment of the present invention.
Figure 9:
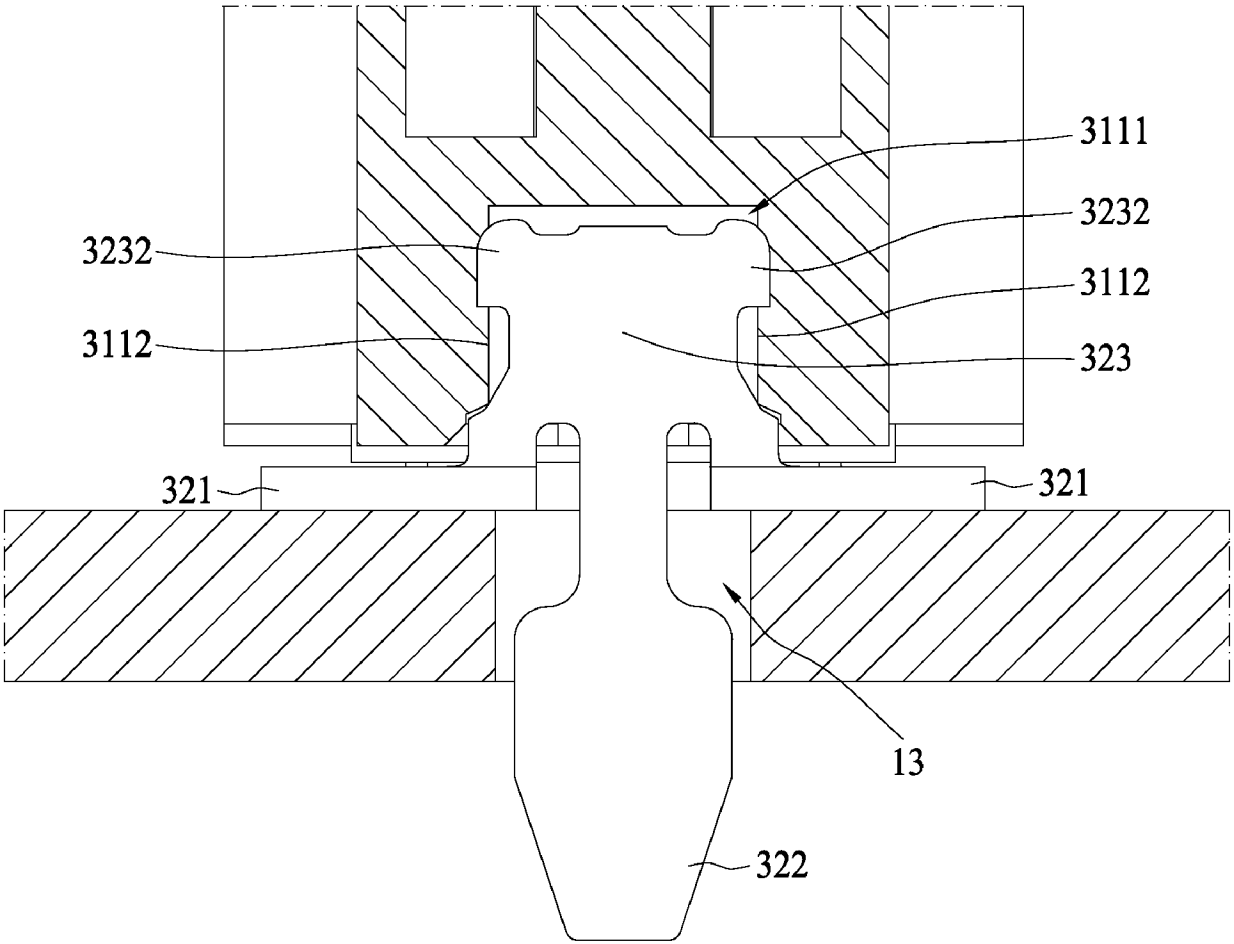
FIG. 9 is a cross-sectional view showing the engagement between a first mount member and a first slit formed on the insulating housing of a card edge connector according to one embodiment of the present invention.

Referring to FIGS. 5, 8, and 9, two first slits 3111 and a second slits 3113 are formed on the bottom of the insulating housing 31 for correspondingly holding the body portions (323 and 333) of the first and second mount members 32 and 33. Two first slits 3111 can be under the respective end portions 311, and the second slit 3113 can be below the polarized rib 314. As shown in FIGS. 8 and 9, the two facing surfaces 3112 partially defining the first slit 3111 are configured in a manner such that the projections 3232 extending from the body portion 323 can form an interference fit with the two surfaces 3112. Although the embodiment of FIGS. 8 and 9 only demonstrates the engagement way of the first slit 3111 and the body portion 323 of the first mount member 32, the body portion 333 of the second mount member 33 and the second slit 3113 can have the similar engagement as well.

In an embodiment, therefore, the card edge connector comprises a pair of mount members, each of which includes a pair of fitting nails for securing the card edge connector by soldering and a tab portion disposed between the fitting nails. The tab portion is configured for positioning the card edge connector during assembly, for restricting the movement of the card edge connector during soldering, and to be freely insertable into an aperture on a printed circuit board so as to allow the shrinkage or expansion of the card edge connector during soldering.

The above-described embodiments of the present invention are intended to be illustrative only. Numerous alternative embodiments may be devised by persons skilled in the art without departing from the scope of the following claims.

What is claimed is:

1. A card edge connector for mounting on a printed circuit board forming a plurality of apertures, the card edge connector comprising:

an insulating housing, comprising:

a pair of opposite end portions;

a card receiving slot extending between the two end portions; and a pair of first slits respectively formed on the bottom of the two end portions;

a plurality of terminals arrayed along the card receiving slot; and a pair of first mount members disposed with respect to the corresponding apertures, each first mount member comprising:

a body portion configured to be received within the respective first slit;

a tab portion connected to the body portion and configured to be freely insertable into the respective aperture; and at least one fitting nail connected to the body portion and configured to be disposed transversely for being soldered on the printed circuit board.

2. The card edge connector of claim 1, further comprising a second mount member and a second slit, wherein the second mount member comprises:

a body portion configured to be received within the second slit; and at least one fitting nail connected to the body portion of the second mount member and configured to be disposed transversely for being soldered on the printed circuit board.

3. The card edge connector of claim 2, wherein the at least one fitting nail of the first mount member comprises a pair of fitting nails of the first mount member spaced apart from each other, and the tab portion of the first mount member is disposed between the two fitting nails of the first mount member.

4. The card edge connector of claim 3, wherein the at least one fitting nail of the second mount member comprises a pair of fitting nails of the second mount member spaced apart from each other, and the body portion of the second mount member is disposed between the two fitting nails of the second mount member.

5. The card edge connector of claim 4, wherein each first mount member further comprises a plurality of connecting portions respectively connecting the fitting nails of the first mount member and the tab portion of the first mount member to an edge of the body portion of the first mount member.

6. The card edge connector of claim 5, wherein the second mount member further comprises a plurality of connecting portions connecting the pair of fitting nails of the second mount member to an edge of the body portion of the second mount member.

7. The card edge connector of claim 6, wherein the second mount member further comprises a tab portion connecting to the body portion of the second mount member and configured to be freely insertable into the respective aperture.

8. The card edge connector of claim 7, wherein each of the fitting nails of the first and second mount members comprises an indentation formed on an edge thereof.

9. The card edge connector of claim 8, wherein each of the body portions of the first and second mount members comprises at least one projection to form an interference fit with the respective one of the first slits and the second slit.

10. The card edge connector of claim 9, further comprising a polarized rib disposed within the card receiving slot, wherein the second slit is below the polarized rib.

11. The card edge connector of claim 1, wherein each of the plurality of terminals comprises a tail portion and the printed circuit board comprises a plurality of contact pads arrayed with respect to the tail portions, wherein the tab portion of each first mount member is configured to move within the respective aperture without causing the tail portion to engage two adjacent contact pads.

* * * * *